US008294700B2

(12) United States Patent
Mizukoshi et al.

(10) Patent No.: US 8,294,700 B2
(45) Date of Patent: Oct. 23, 2012

(54) DISPLAY DEVICE

(75) Inventors: Seiichi Mizukoshi, Tokyo (JP); Nobuyuki Mori, Tokyo (JP); Makoto Kohno, Tokyo (JP)

(73) Assignee: Global OLED Technology LLC, Hemdon, VA (US)

( * ) Notice: Subject to any disclaimer, the term of this patent is extended or adjusted under 35 U.S.C. 154(b) by 156 days.

(21) Appl. No.: 13/020,544

(22) Filed: Feb. 3, 2011

(65) Prior Publication Data

US 2012/0032940 A1 Feb. 9, 2012

(30) Foreign Application Priority Data

Feb. 4, 2010 (JP) ..... 2010-023286

(51) Int. Cl.
*G09G 3/30* (2006.01)

(52) U.S. Cl. ..... 345/212; 345/76

(58) Field of Classification Search ..... 345/55, 345/76, 77, 82, 204, 211, 212, 213; 315/169.1, 315/169.3; 313/500
See application file for complete search history.

(56) References Cited

U.S. PATENT DOCUMENTS 8,072,400 B2 * 12/2011 Mizukoshi et al. ..... 345/77
2004/0150592 A1 8/2004 Mizukoshi et al.
2007/0210996 A1 9/2007 Mizukoshi et al.
2008/0088567 A1 4/2008 Mizukoshi et al.
2009/0256783 A1 10/2009 Mizukoshi et al.

FOREIGN PATENT DOCUMENTS

JP 2004/264793 9/2004
JP 2005/284172 10/2005
JP 2008/098057 4/2008
JP 2009/258301 11/2009

* cited by examiner

*Primary Examiner* — Abbas Abdulselam

(74) *Attorney, Agent, or Firm* — Morgan, Lewis & Bockius LLP

(57) ABSTRACT

Noise on a current to be measured is removed. Horizontal power supply lines (PVDD) are arranged in a horizontal direction and supply a current to pixels in respective corresponding horizontal lines. A switch (8) connects a group of the horizontal power supply lines (PVDD) to a first power supply line (PVDDa) or a second power supply line (PVDDb) disposed outside a pixel region in a switchable manner. Only the horizontal power supply lines (PVDD) in a group to which a pixel to be measured belongs are supplied with power from the second power supply line (PVDDb) so as to measure a current of each pixel in the group, and a current flowing into a power source (PVDDa) connected to a group to which other pixels than the pixel to be measured belong is measured, to thereby calculate a pixel current based on a difference between the two measured currents.

2 Claims, 16 Drawing Sheets

DISPLAY DEVICE

The present invention claims the benefit of Japanese Patent Application No. 2010-23286, filed in Japan on Feb. 4, 2010, which is hereby incorporated by reference.

BACKGROUND OF THE INVENTION

1. Field of the Invention

The present invention relates to a method of measuring a pixel current in a display device in which pixel data for display is written into each pixel arranged in matrix.

2. Description of the Related Art

FIG. 1 illustrates a basic circuit configuration of a pixel (sub-pixel in a color panel) in an active matrix type organic electroluminescence (EL) display device. FIG. 2 illustrates an exemplary configuration of a display panel, and signals input thereto.

While keeping a horizontally-extending gate line (Gate) at high level to turn ON a selection thin film transistor (TFT) 2, a data signal having a voltage corresponding to display luminance is superimposed on a vertically-extending data line (Data), to thereby accumulate the data signal into a storage capacitor C. The storage capacitor C allows a drive TFT 1 to supply a drive current corresponding to the data signal to an organic EL element 3, and the organic EL element 3 emits light.

Here, the emission amount of the organic EL element and its current have a substantially proportional relationship. Generally, a voltage (Vth) at which a drain current starts to flow near the black level of an image is applied between a gate of the drive TFT 1 and PVdd. As an amplitude of the image signal, an amplitude which results in predetermined luminance near the white level is applied.

As illustrated in FIG. 2, the panel has pixels 6 arranged in matrix, in which the gate lines Gate extend from a gate driver 4 and are disposed for each row of the pixels 6. The gate lines Gate for lines to write data signals are sequentially changed to the high level and the respective selection TFTs 2 are turned ON. The data lines Data, on the other hand, extend from a source driver 5 and are disposed for each column of the pixels, and the data signals of the corresponding pixels 6 are sequentially superimposed on the data lines Data. To perform this operation, the gate driver and the source driver are supplied as necessary with an image data signal, horizontal and vertical synchronization signals, a pixel clock, and other drive signals.

FIG. 3 illustrates a relation of a CV current (corresponding to luminance) flowing through the organic EL element 3 with respect to a data (Data) voltage of the drive TFT 1 (voltage of the data signal on the data line Data). The data signal is determined so that Vb is applied as the black level voltage and Vw is applied as the white level voltage, to thereby enable appropriate gradation control on the organic EL element 3.

A current flowing when the pixel is driven at a given data voltage is dependent on the characteristics of the drive TFT 1, such as the voltage Vth and the slope of the V-I curve (μ). Accordingly, luminance unevenness occurs if the characteristics of Vth and a fluctuate among the drive TFTs 1 in the panel. In order to correct the luminance unevenness, it is necessary to input a data voltage for obtaining the same luminance with the same input signal value to each pixel. For that reason, one or a predetermined number of pixels in the panel are lit at different signal levels, and the V-I curve of the TFT is determined based on panel currents at the respective signal levels (see Japanese Patent Application Laid-open Nos. 2004-264793 and 2005-284172).

The current flowing in one pixel, which depends on the efficiency of the organic EL element and the pixel density, is usually several μA or less even for light emission at the maximum available luminance. It is therefore necessary to measure a current of 1 μA or less especially in determining fluctuations in current value near black. Accordingly, intruding noise from outside the panel and noise from the drive circuitry inside the panel may cause the deterioration in measurement accuracy. As a countermeasure, in Japanese Patent Application Laid-open No. 2008-098057, a PVDD current and a CV current are measured at a time and added together so as to remove common-mode noise.

By the way, the plurality of pixels 6 use a common line for supplying power PVdd to a source of the drive TFT 1, and hence, if resistive components due to wiring are present, a source voltage of the drive TFT 1 for driving the organic EL element 3 varies depending on the amount of current flowing in other pixels 6, though the resistive components are omitted in the circuits of FIGS. 1 and 2. If the source voltage of the drive TFT 1 drops while the selection TFT 2 is being turned ON to write the data voltage into the storage capacitor C, an absolute value of Vgs of the drive TFT 1 becomes small. As a result, the current of the drive TFT 1 reduces and the current of the organic EL element 3 also reduces to lower the emission luminance.

In order to solve the problem, Japanese Patent Application Laid-open No. 2009-258301 discloses the configuration as illustrated in FIG. 4, in which two kinds of vertical PVDD power supply lines, that is, a power supply line PVDDa for pixel lighting and a power supply line PVDDb for pixel data writing are provided, and a switch 8 switches the voltage source of a horizontal PVDD line for supplying the PVDD voltage to the pixels 6 in the corresponding horizontal lines. The switching of the switch 8 provided for each horizontal line is controlled by a control signal Ctl supplied from a PVDD line selection circuit 7.

FIG. 4 is a diagram illustrating three columns (n+2 to n) of pixels 6 in four horizontal lines (m to m+3), and FIG. 5 illustrates its overall configuration focusing on the power supply lines (vertical PVDD lines PVDDa and PVDDb and the horizontal PVDD lines). Note that, the voltages of the vertical PVDD lines PVDDa and PVDDb are referred to as PVDDa and PVDDb, respectively.

Here, the PVDD line selection circuit 7 and the switch 8 for PVDD may be formed of a TFT or may employ an IC chip provided with such a function. In normal usage, during lighting, the switches 8 are turned to the "a" side so that power may be supplied from the vertical PVDD line PVDDa. In writing a data voltage, the corresponding switch 8 is turned to the "b" side so that power may be supplied from the vertical PVDD line PVDDb having a voltage sufficiently lower than the lighting voltage on the vertical PVDD line PVDDa. In other words, a pixel current is reduced during the data voltage writing so as to prevent voltage drop in the PVDD line. FIG. 4 is a diagram illustrating a state of writing pixel data in the horizontal line m+1, in which all the switches 8 of the other horizontal PVDD lines with the omitted part included are turned to the "a" side.

FIG. 6 illustrates timing relations between the gate line Gate and the control signal Ctl. A vertical synchronization signal VD is changed to H level every frame. In each frame, the gate signal Gate and the control signal Ctl are sequentially turned ON every horizontal line, to thereby write the data signal into the corresponding pixel while the power supply voltage is being supplied from the vertical PVDD line PVDDb.

As illustrated in FIG. 7, the switch 8 may be provided every plurality of horizontal PVDD lines. FIG. 7 is a diagram illustrating three columns of pixels in four lines in the case where the switch 8 is provided every four horizontal PVDD lines, and FIG. 8 illustrates its overall configuration focusing on the power supply lines. When pixel data is written, the switch 8 for a group to which the pixel to be written belongs is turned to the "b" side so that power may be supplied from the vertical PVDD line PVDDb, and at the same time, the gate selection line Gate on the line to which the pixel to be measured belongs is changed to the high level.

The data voltage is written line by line in order from the upper part of the screen, and hence in FIG. 7, the gate lines Gatem to Gatem+3 are sequentially changed to the high level while the switch 8 is turned to the "b" side. When the writing on the horizontal lines in the group is completed, the switch 8 is switched to the "a" side, and the horizontal PVDD lines in the next group of the lines m+4 to m+7 are connected to PVDDb by another corresponding switch 8. FIG. 9 illustrates a wiring example of the power supply lines in the case where the switches 8 are provided on both sides.

In a compact panel with fewer pixels, leakage currents from other pixels are small, and a capacitive component of the PVDD line, which affects the measurement speed, is also small. Therefore, as in Japanese Patent Application Laid-open No. 2008-098057 described above, it is possible to measure a current at a PVDD terminal by supplying a current to only one pixel while connecting PVdd in all the pixels. However, in a large-sized panel with more pixels, a total amount of noise due to leakage currents from OFF pixels other than the pixel to be measured becomes large to lower the measurement accuracy. Further, there is another problem that the pixel current cannot be measured at high speed because of the influence of time constant due to the capacitive component of the PVDD line.

Meanwhile, a large panel with more pixels has large current consumption and a long PVDD line, and hence the voltage drop in the PVDD line is a serious issue and it is desired to separate the PVDD line into the one for pixel data writing and the one for light emission as in Japanese Patent Application Laid-open No. 2009-258301 described above.

In this case, a preferred manner of measuring a pixel current is such that only the switch for a group of the PVDD lines to which the pixel to be measured belongs is brought into a connected state to apply a voltage thereto and measure the pixel current. In this manner, capacitive components on the PVDD lines in other groups can be eliminated, and leakage currents from the pixels in the other groups can also be eliminated.

However, if PVdd in the pixels other than the group including the pixel to be measured is disconnected during the measurement, amounts and waveforms of intruding noise are considerably different for PVDD and CV. Therefore, in the method of Japanese Patent Application Laid-open No. 2008-098057 assuming that intruding common-mode noise (intruding noise from outside the panel and noise from the drive circuits inside the panel) is not so different for PVDD and CV, it is difficult to remove the common-mode noise.

SUMMARY OF THE INVENTION

The present invention provides an active matrix type display device including: pixels arranged in matrix, each including a current-driven type light emitting element, and a transistor for controlling a current of the current-driven type light emitting element to perform display; horizontal power supply lines arranged in a horizontal direction, for supplying a current to pixels in respective corresponding horizontal lines; and a switch for connecting each group of the horizontal power supply lines, the each group including at least one horizontal power supply line, to one of a power supply line and a second power supply line in a switchable manner, the power supply line and the second power supply line being disposed outside a pixel region, in which only the at least one horizontal power supply line in a group to which a pixel to be measured belongs is supplied with power from one of the first power supply line and the second power supply line so as to measure a current of each pixel in the group, and a current flowing into a power source connected to a group to which other pixels than the pixel to be measured belong is measured, to thereby calculate a pixel current based on a difference between the two measured currents.

Further, it is preferred that the pixel current be a value determined by subtracting, from a current flowing into another power source connected to the group to which the pixel to be measured belongs, a value determined by multiplying, by a coefficient, a current flowing into the power source connected to at least one group to which the pixels other than the pixel to be measured belong.

According to the present invention, when the pixel current is measured, it is possible to reduce the influence of intruding noise and external noise on various control pulses.

DETAILED DESCRIPTION OF THE PREFERRED EMBODIMENT

Now, an embodiment of the present invention is described below with reference to the accompanying drawings.

Figure 1:
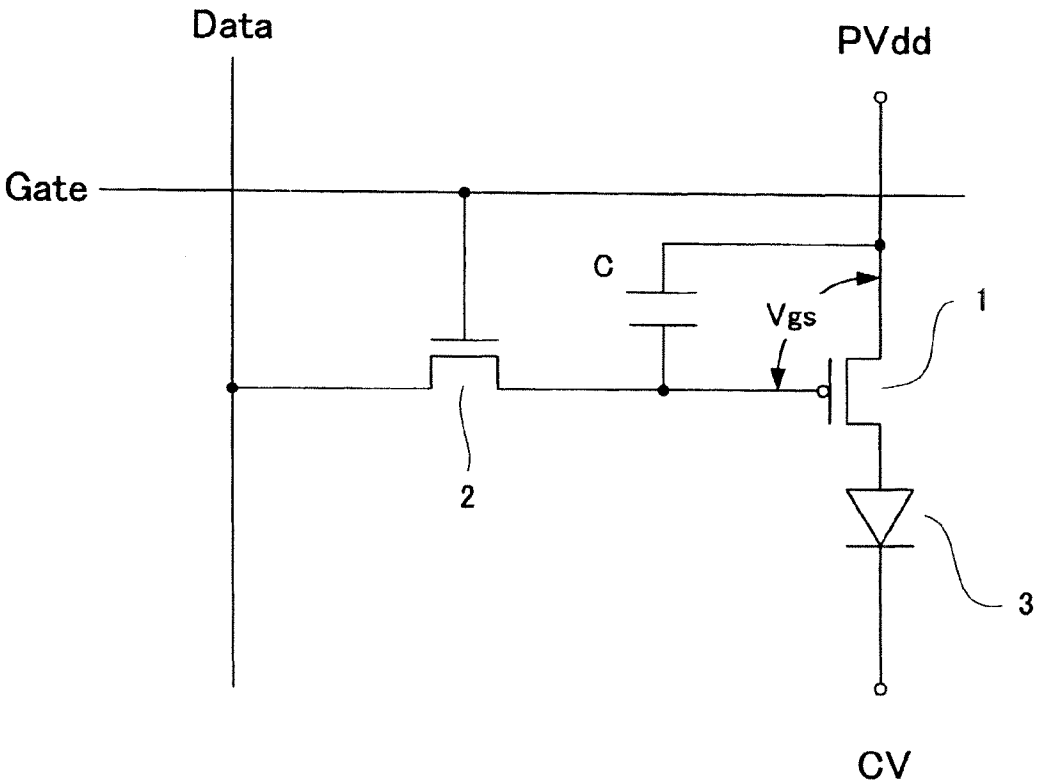
FIG. 1 is a diagram illustrating a configuration of a pixel circuit.
Figure 2:
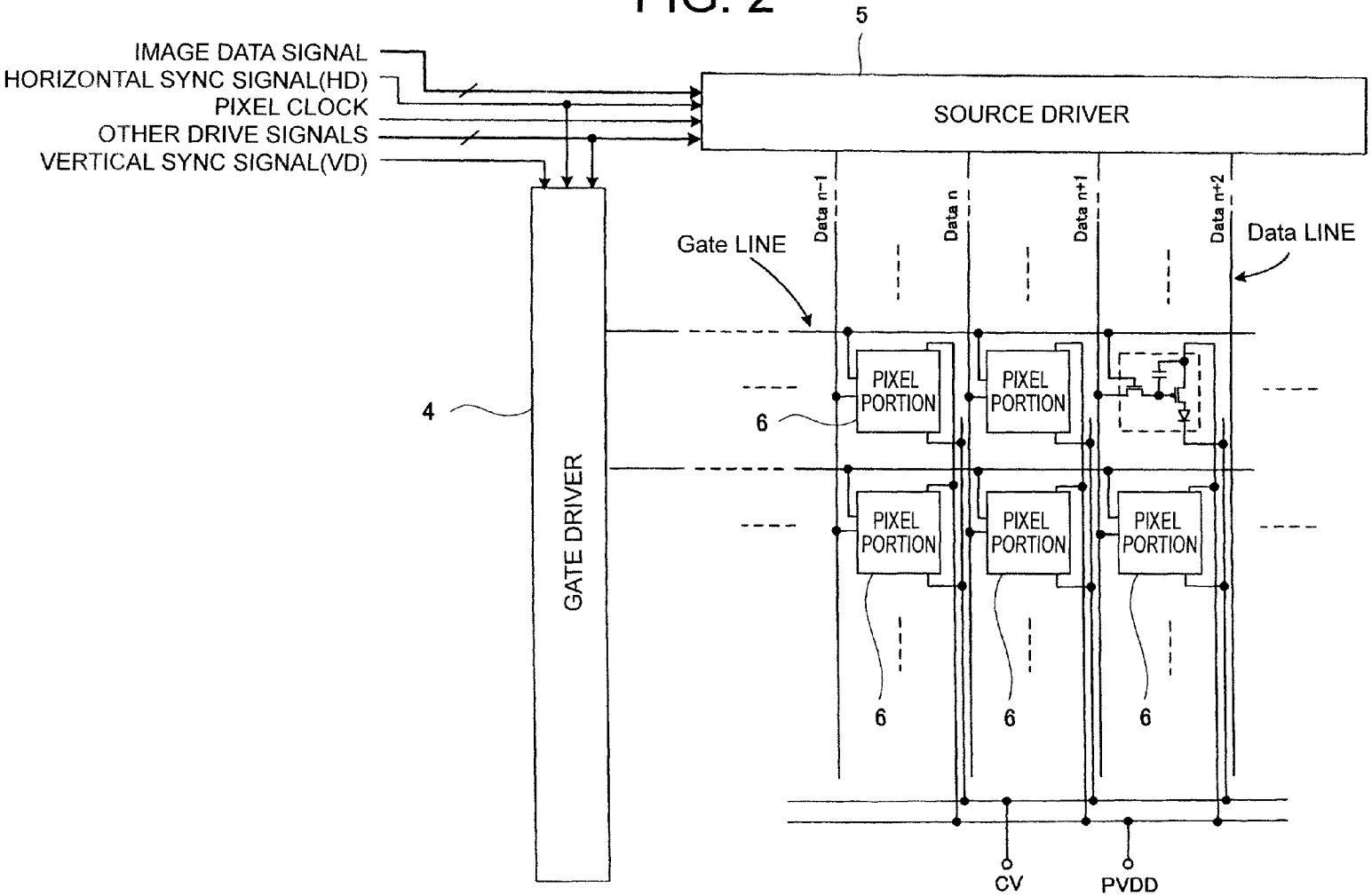
FIG. 2 is a diagram illustrating a configuration of a display panel.
Figure 3:
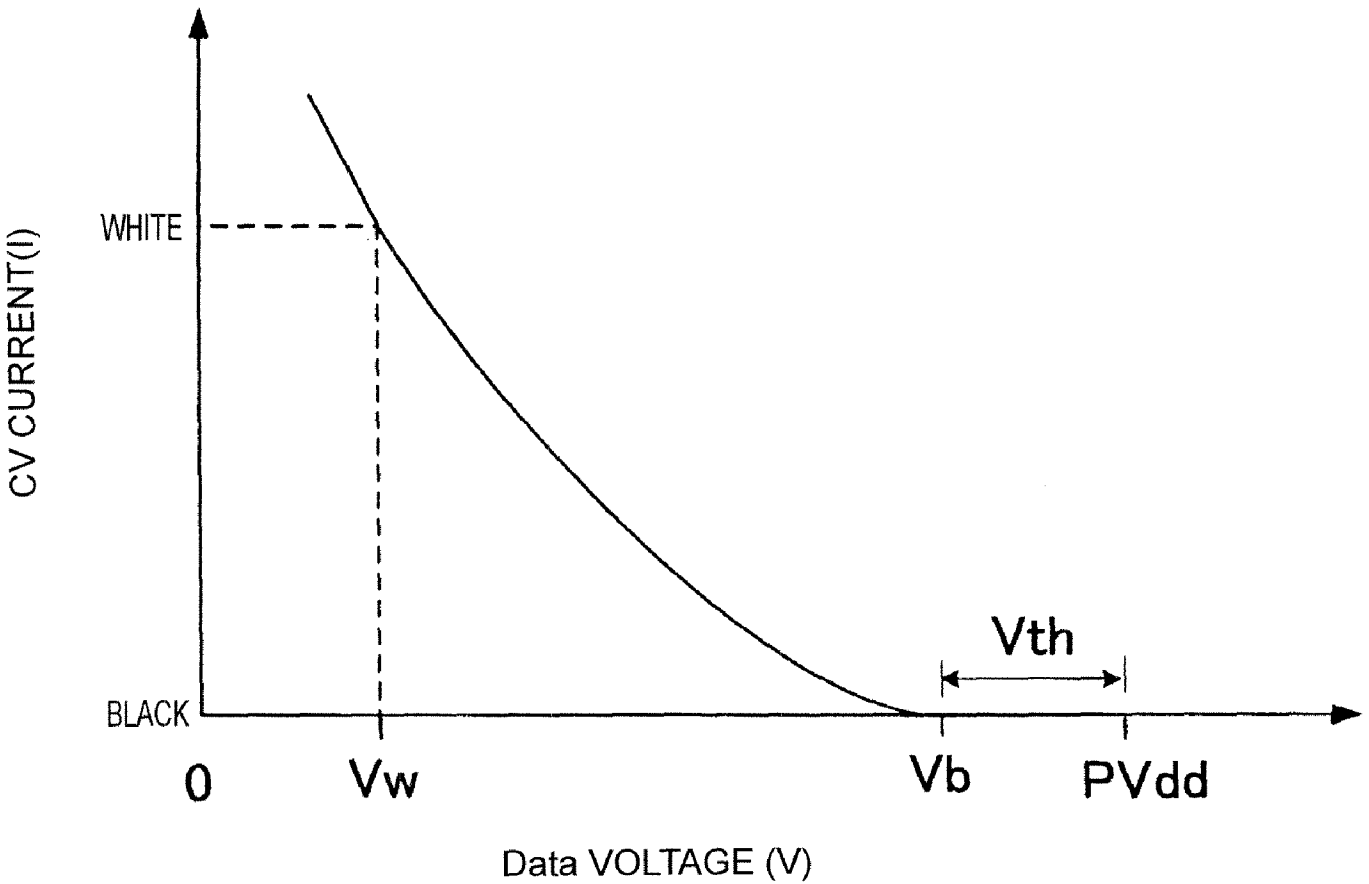
FIG. 3 is a characteristic graph illustrating a relation between a data voltage and a CV current.
Figure 4:
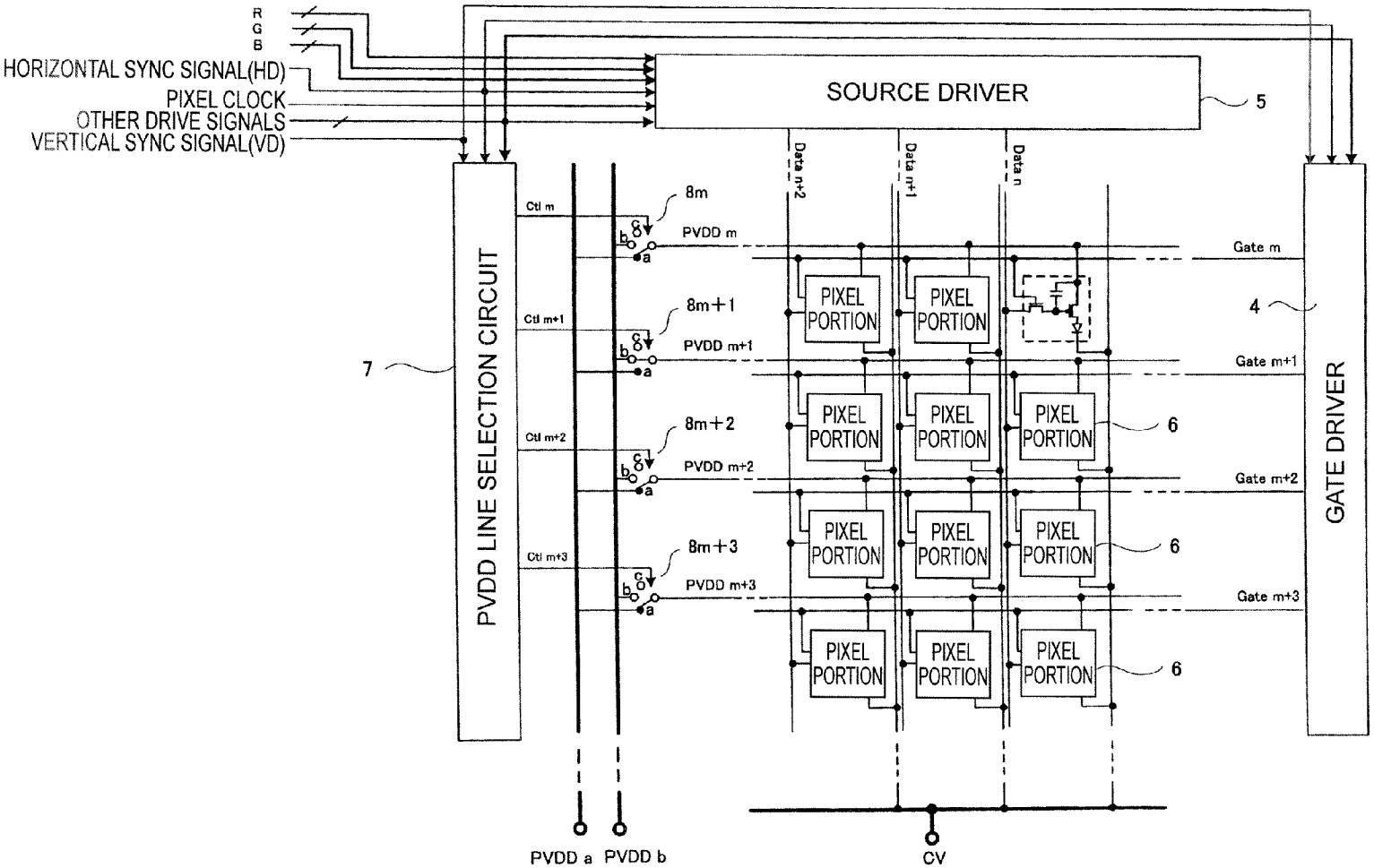
FIG. 4 is a diagram illustrating a configuration of a display panel.
Figure 5:
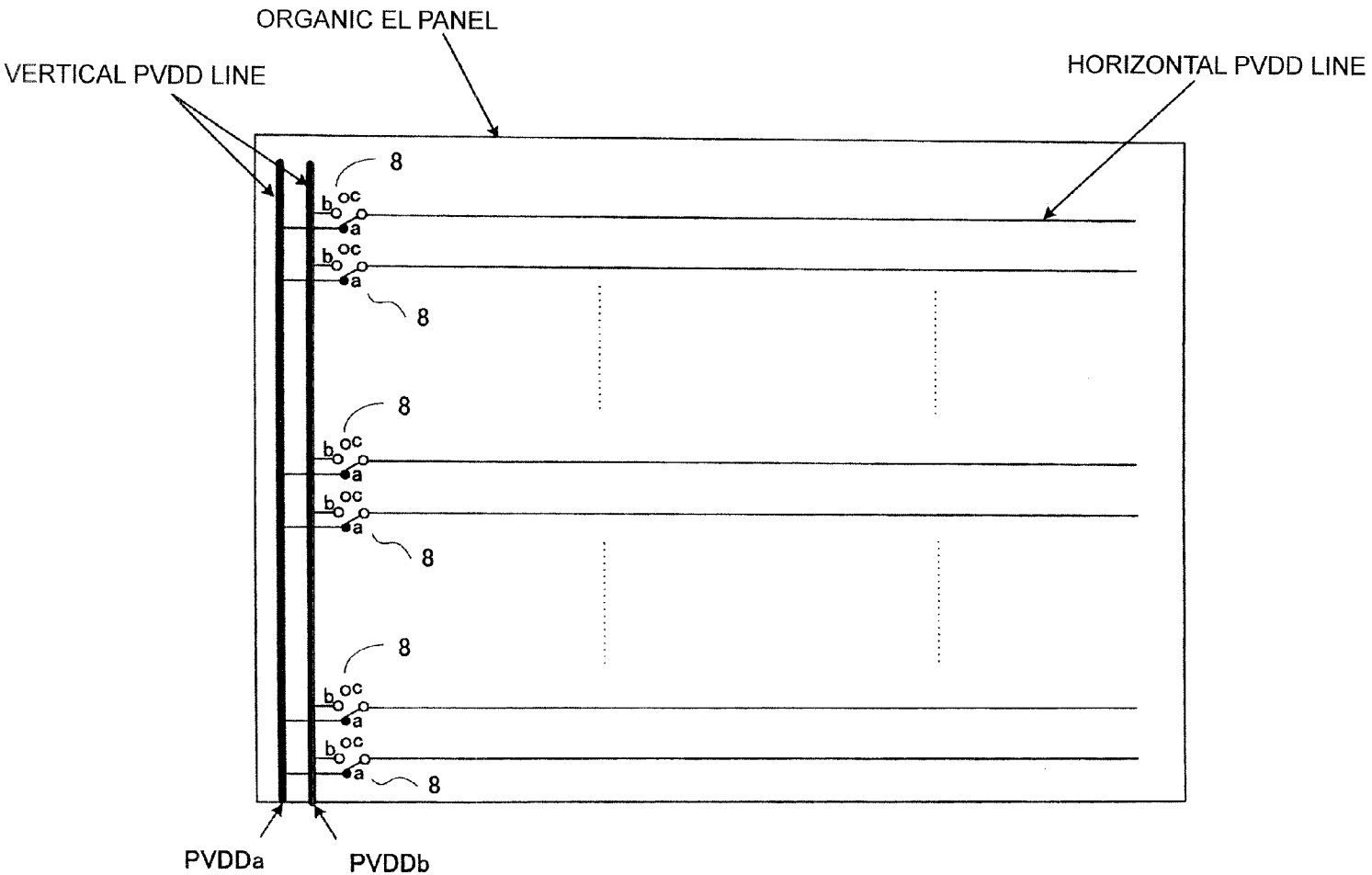
FIG. 5 is a diagram illustrating only power supply lines.
Figure 6:
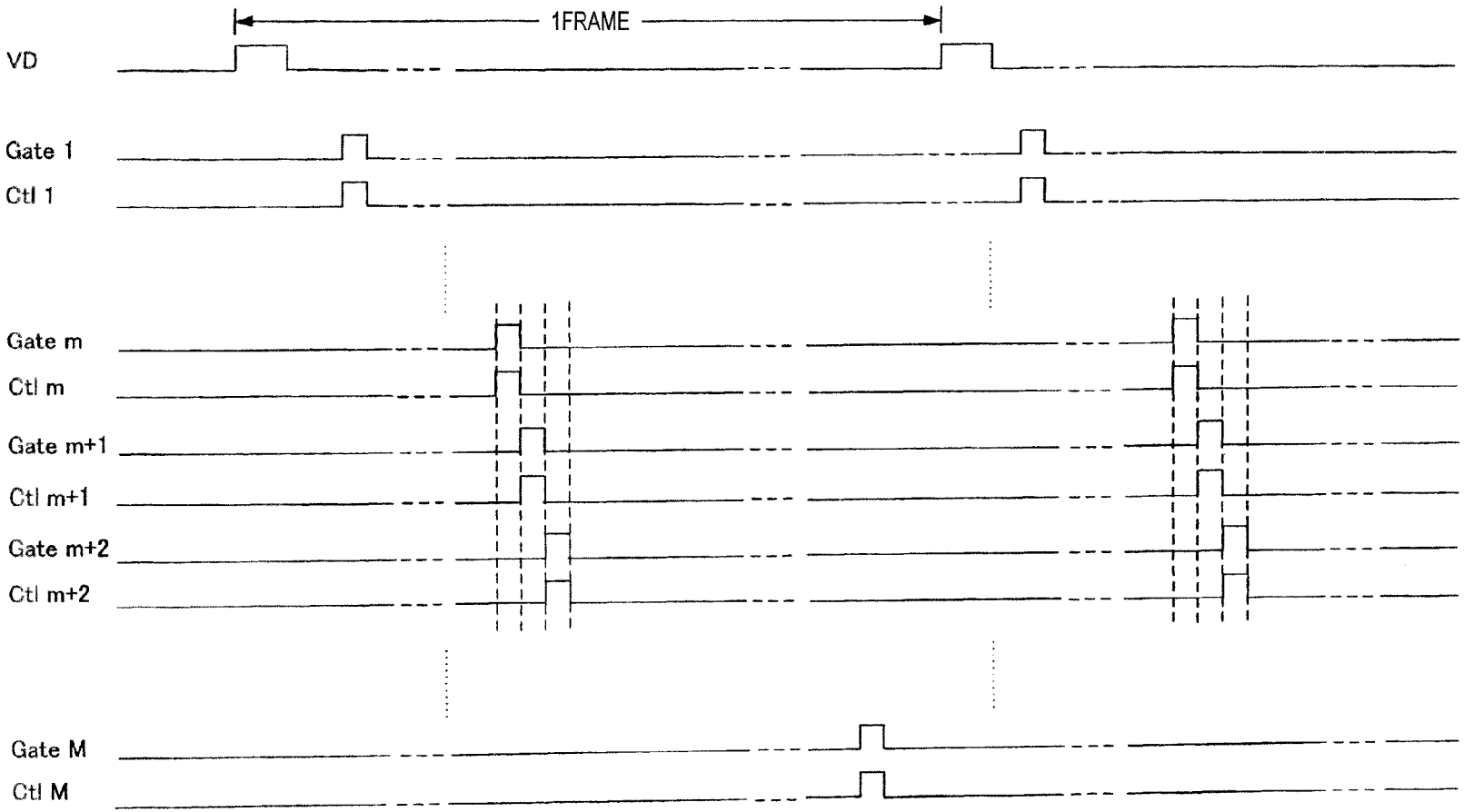
FIG. 6 is a diagram illustrating timings of gate lines and control signals.
Figure 7:
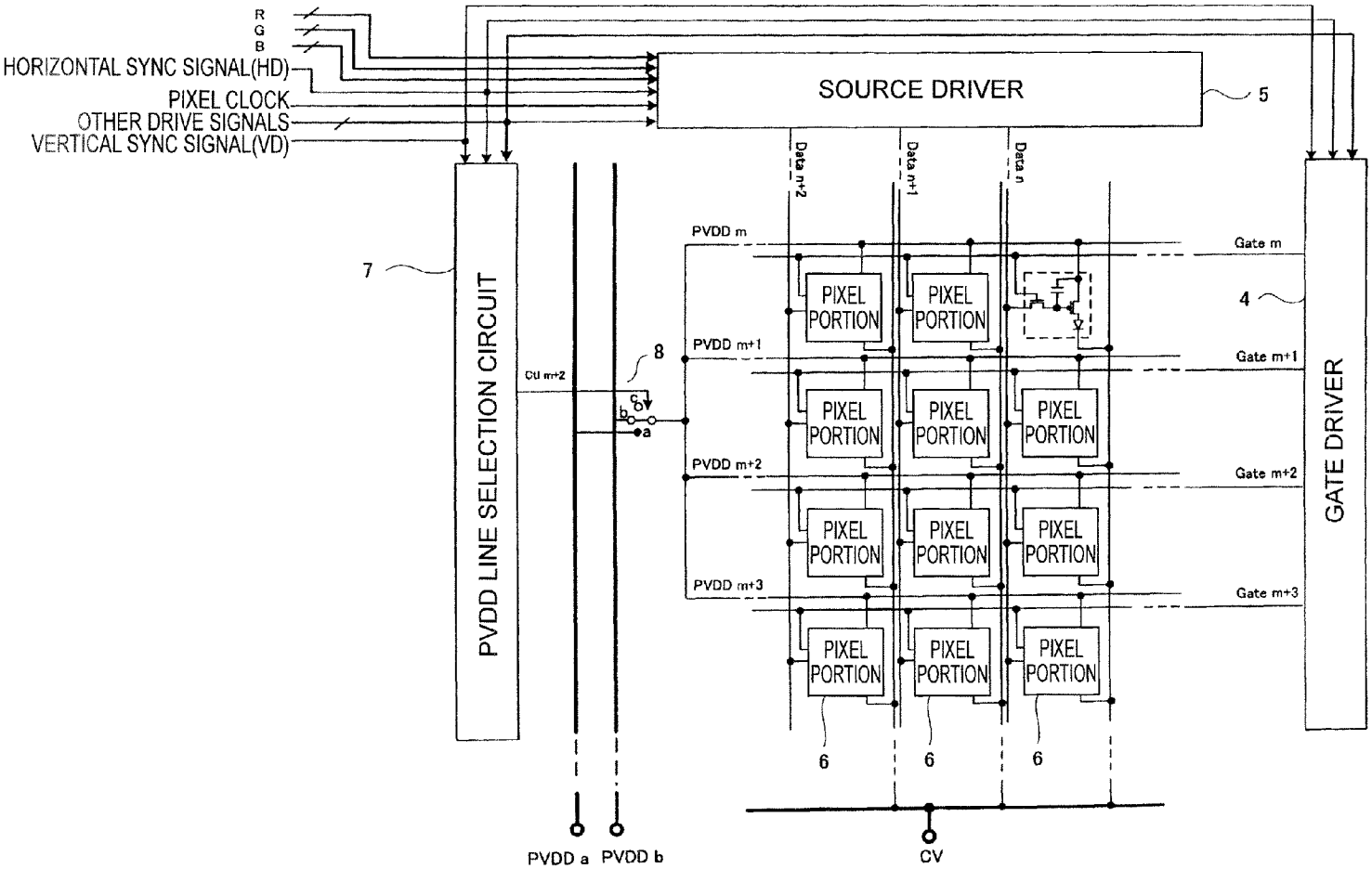
FIG. 7 is a diagram illustrating a configuration of a display panel.
Figure 8:
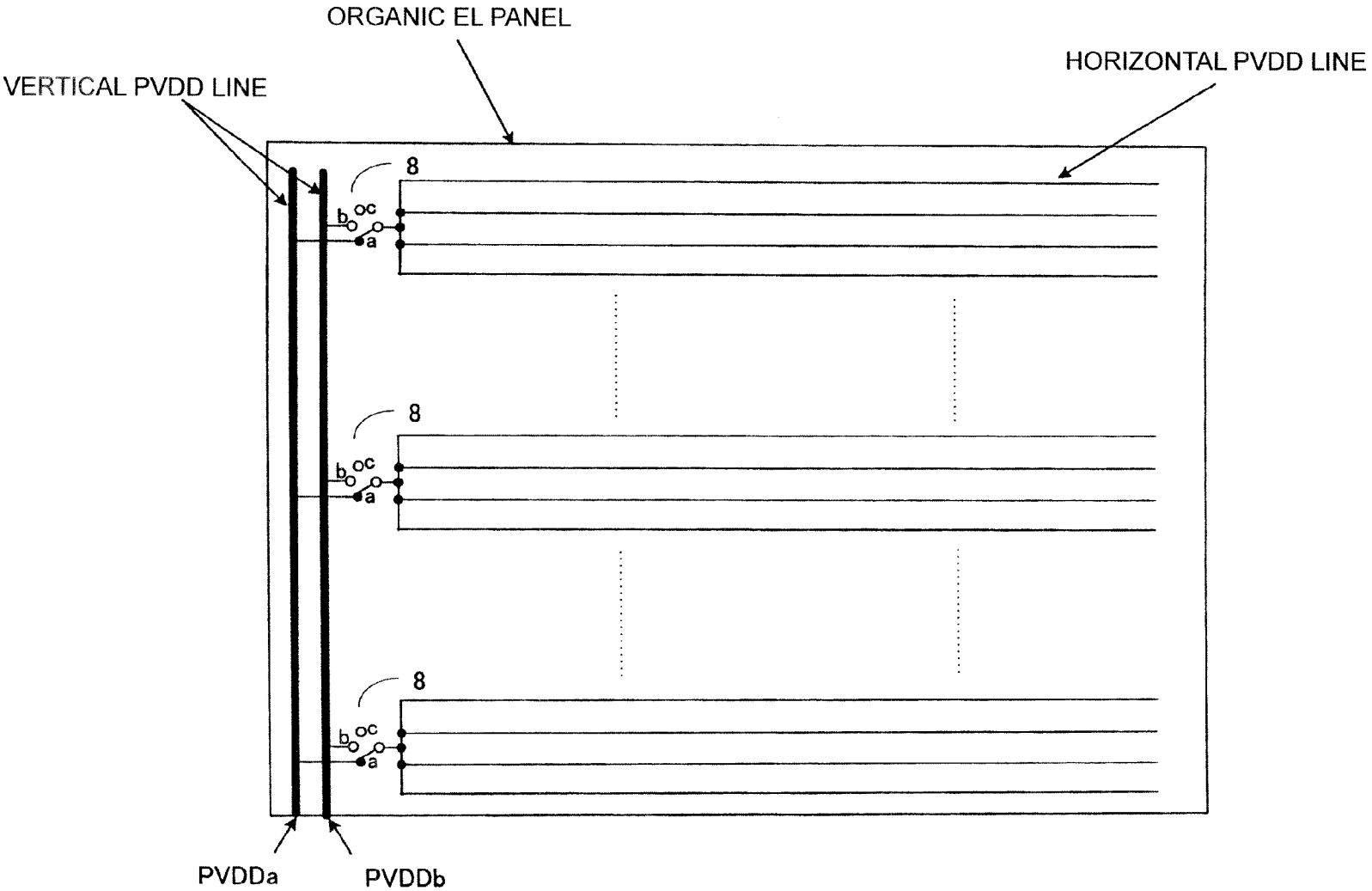
FIG. 8 is a diagram illustrating only power supply lines.
Figure 9:
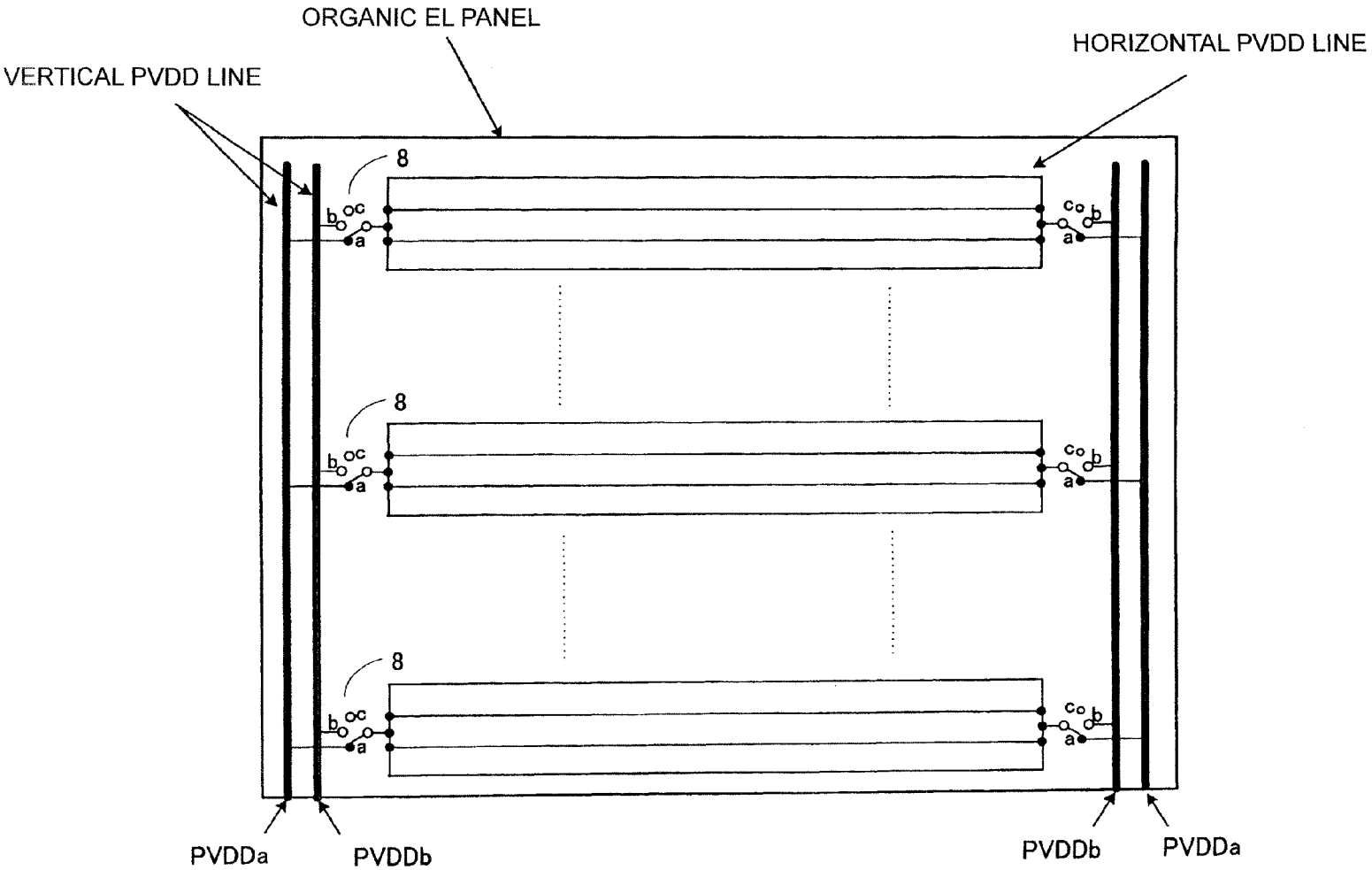
FIG. 9 is a diagram illustrating a configuration of the power supply lines in the case where horizontal PVDD lines are grouped.

In this embodiment, a display device employs a basic configuration as illustrated in FIG. 7, in which a switch is provided every four horizontal PVDD lines. When measuring a pixel current of each pixel, the respective connections of a vertical PVDDa line, a vertical PVDDb line, and a CV line to power sources are set as illustrated in FIG. 11 in a manner different from usual display.

Figure 11:
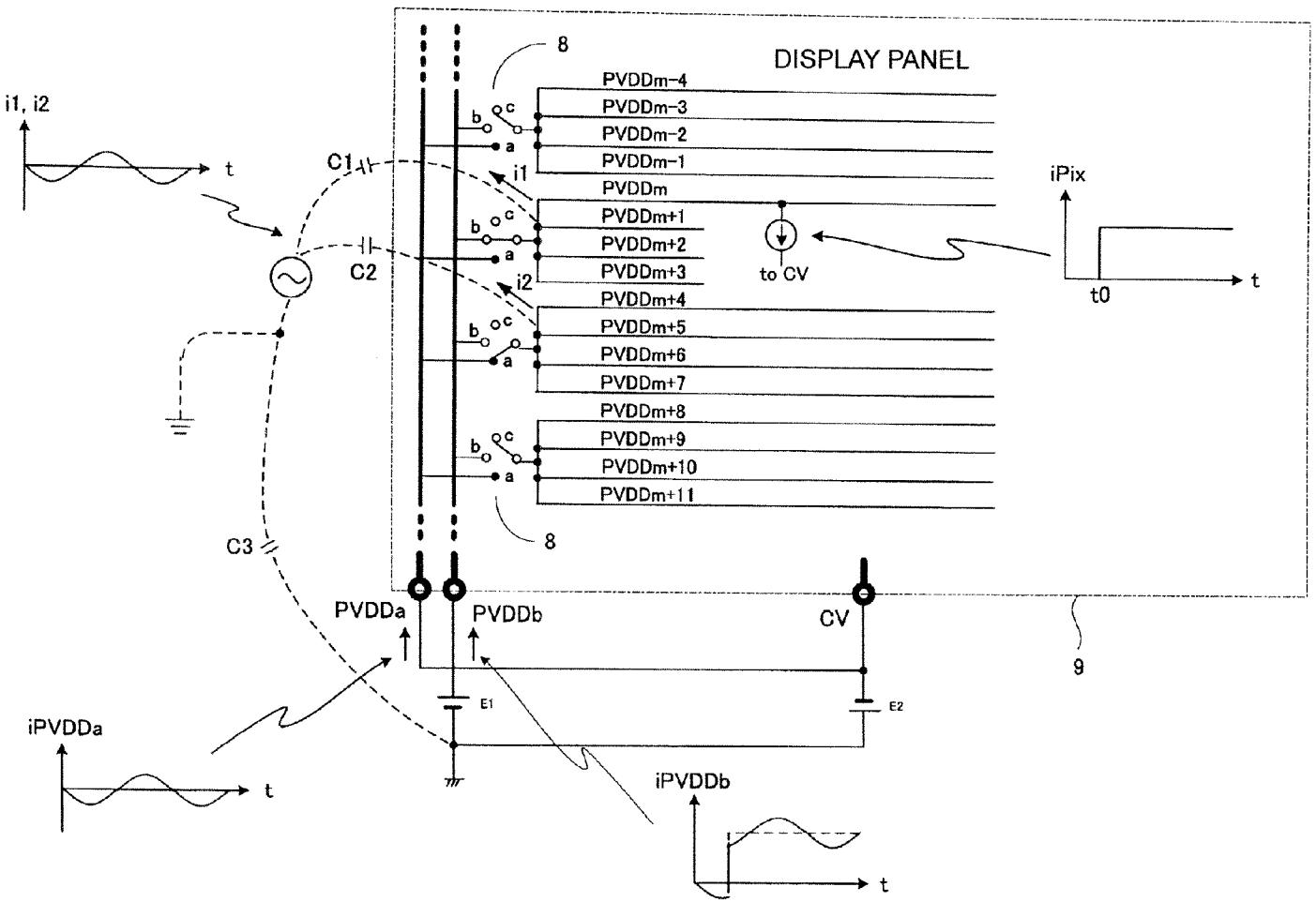
FIG. 11 is a diagram illustrating how noise enters two groups of the horizontal PVDD lines.

Referring to FIG. 11, the operation of switches 8 for measuring the pixel current is described. The vertical PVDD line PVDDa is connected to the common power source CV, which is connected to a cathode of an organic EL element of each pixel. The common power source CV is connected to the ground via a negative voltage power source E2. Therefore, the common power source CV and the vertical PVDD line PVDDa are set to have a voltage lower than the ground by E2. On the other hand, the PVDDb line is connected to the ground via a power source E1 and set to have a voltage higher than the ground by E1.

This example illustrates the measurement of a current of pixels in a PVDDm line. In this case, in order to supply power from the vertical PVDD line PVDDb to a group to which the PVDDm line as the m-th horizontal PVDD line belongs, the corresponding switch 8 is turned to the "b" side, and a gate selection line Gate for the line m is set to high level to turn ON selection thin film transistors (TFTs) 2 in the PVDDm line. A source driver 5 is controlled so that data corresponding to black is output to pixels 6 other than the pixel 6 to be measured. Because the black data is written into the pixels 6 other than the pixel 6 to be measured, a current flowing from the vertical PVDD line PVDDb is the sum of a current of the pixel 6 to be measured and leakage currents of the other pixels 6 in the group. The leakage currents, however, have much less influence than the case where PVdd lines of all the pixels in the screen are connected. Other horizontal PVDD line groups than the group to which the line m belongs do not need to be supplied with power, and hence the corresponding switches may be turned in positions other than the PVDDb side. In FIG. 11, the switches 8 are turned to the "c" side.

Figure 10:
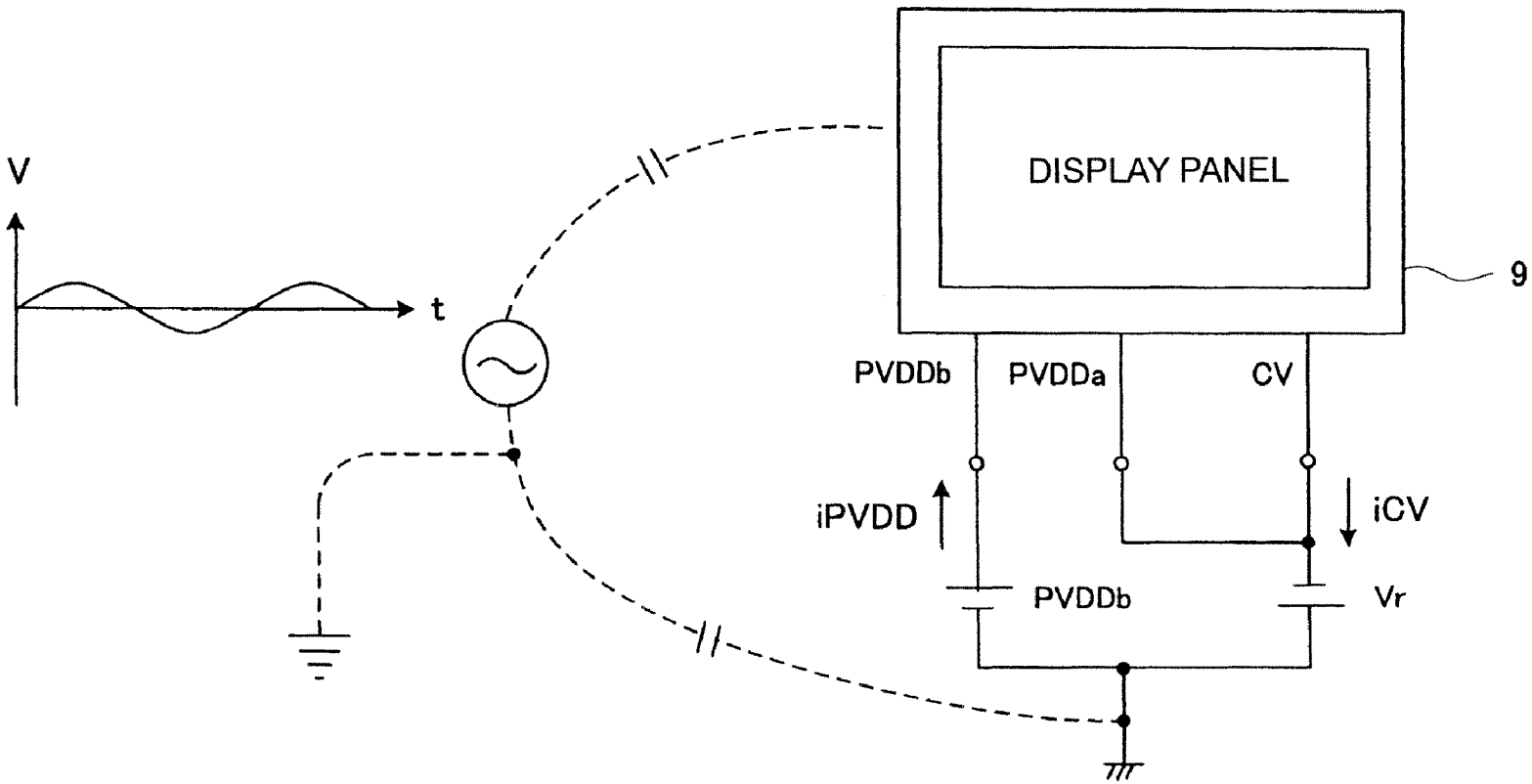
FIG. 10 is a diagram illustrating how noise enters the panel.

Here, intruding noise from outside the panel and noise from the drive circuits inside the panel enter the current on the PVDDb line. FIG. 10 illustrates how noise intrudes from the outside via floating capacitors. In FIG. 10, a noise source is illustrated as an AC power source, and the noise (AC signal) from the noise source enters the power supply lines and the ground lines of a display panel 9 via the floating capacitors.

In FIG. 11, floating capacitors C1 and C2 existing between different PVDD line groups and the noise source are supposed to be substantially equal. Accordingly, substantially equal noise (i1, i2) intrudes into the group to which the horizontal PVDDm line belongs and a group to which a horizontal PVDDm+4 line belongs, which is adjacent to the group to which the horizontal PVDDm line belongs. The noise is therefore cancelled out under the assumption of i1≈i2.

Figure 12:
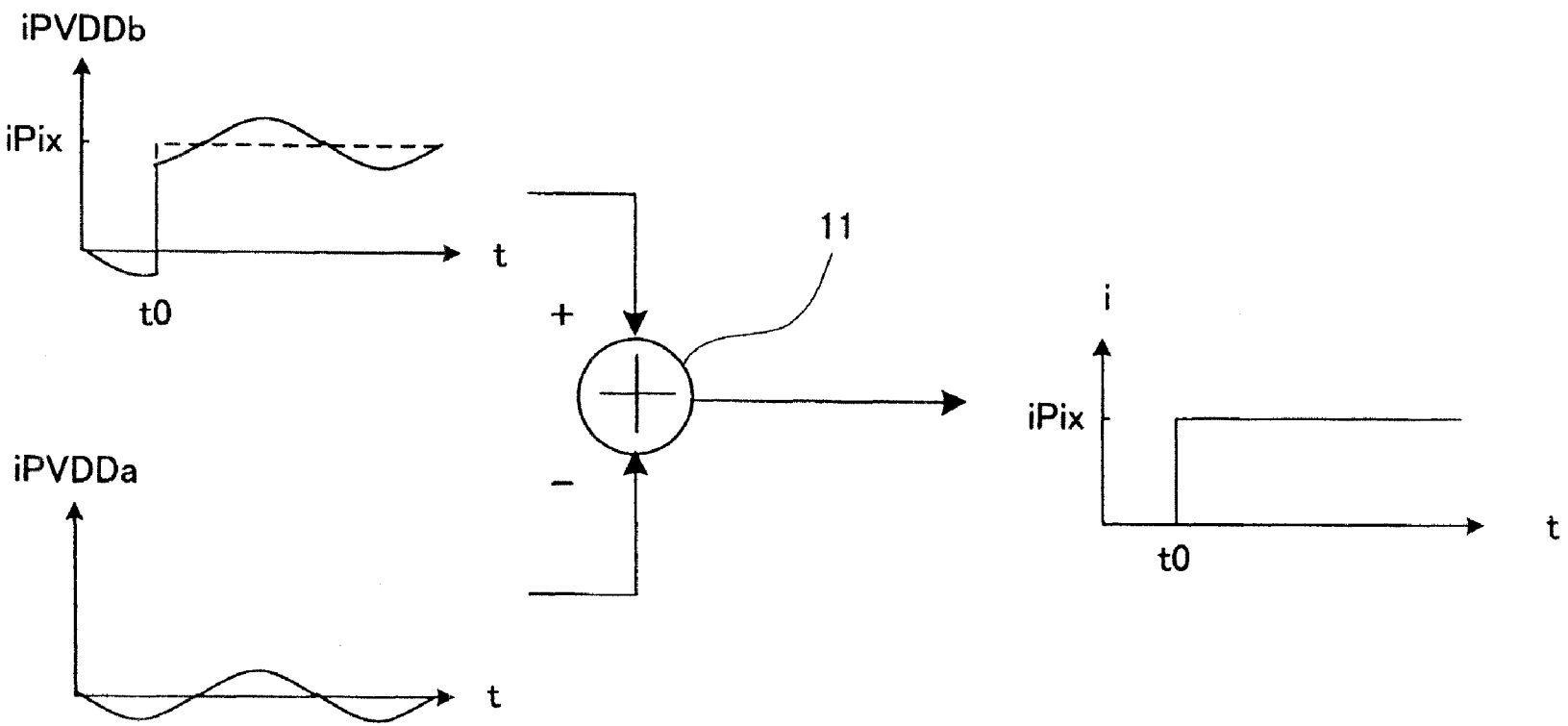
FIG. 12 is a diagram illustrating a configuration for removing noise.

In other words, using the switches 8, the group to which the PVDDm line belongs and the group to which the PVDDm+4 line belongs are connected to the vertical PVDD line PVDDb and the vertical PVDD line PVDDa, respectively, whereas the switches 8 for the other groups are turned to the "c" side to be opened. A PVDDa terminal, which is an external terminal of the vertical PVDD line PVDDa, is connected to CV, and hence i2 is the only current flowing to the PVDDa terminal. Therefore, as illustrated in FIG. 12, by providing an adder 11 to subtract a current value flowing to the PVDDa terminal from a current value flowing into a PVDDb terminal, it is possible to reduce common-mode noise intruding from the outside.

Figure 13:
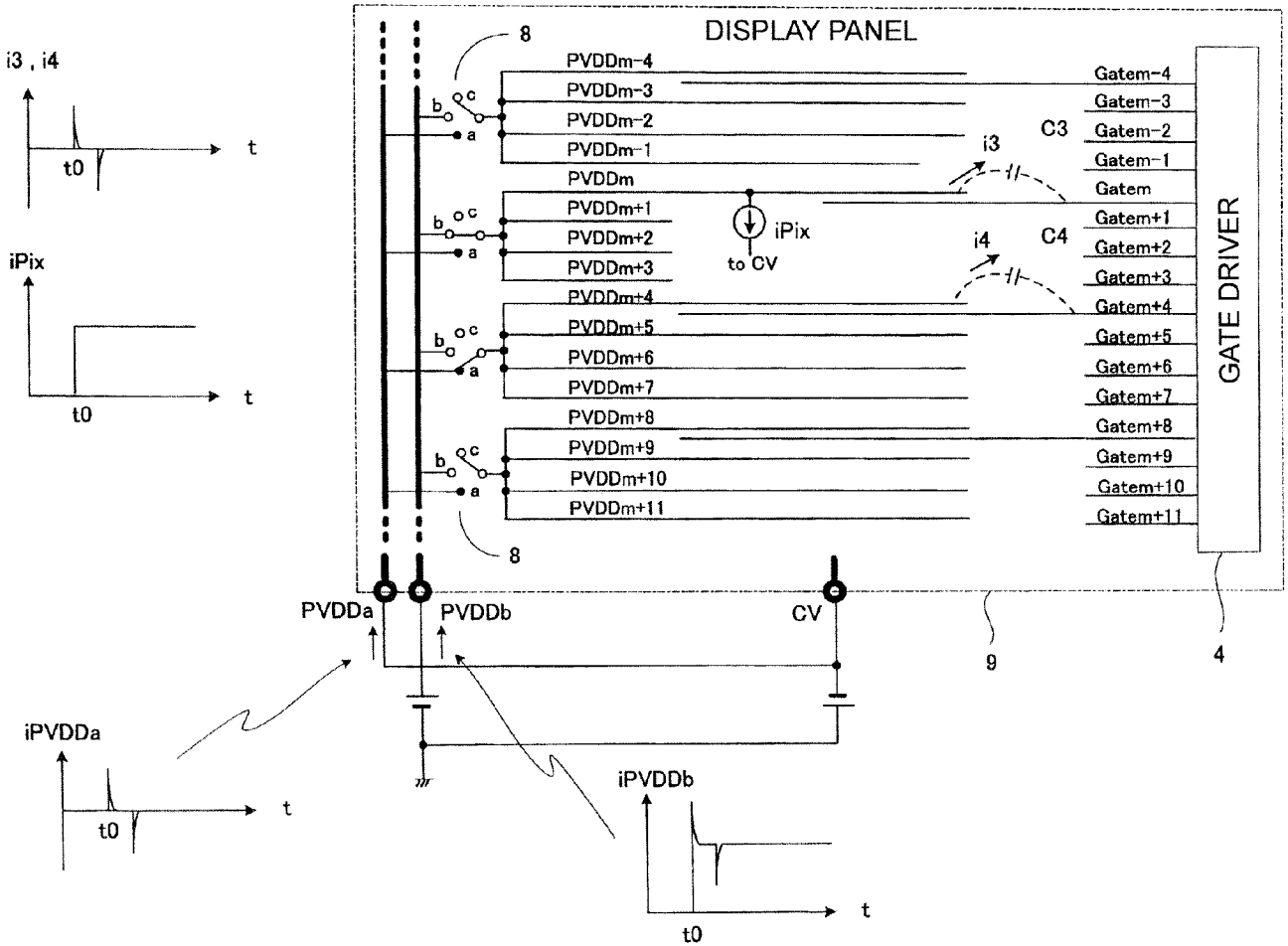
FIG. 13 is a diagram illustrating how noise enters the panel.
Figure 14:
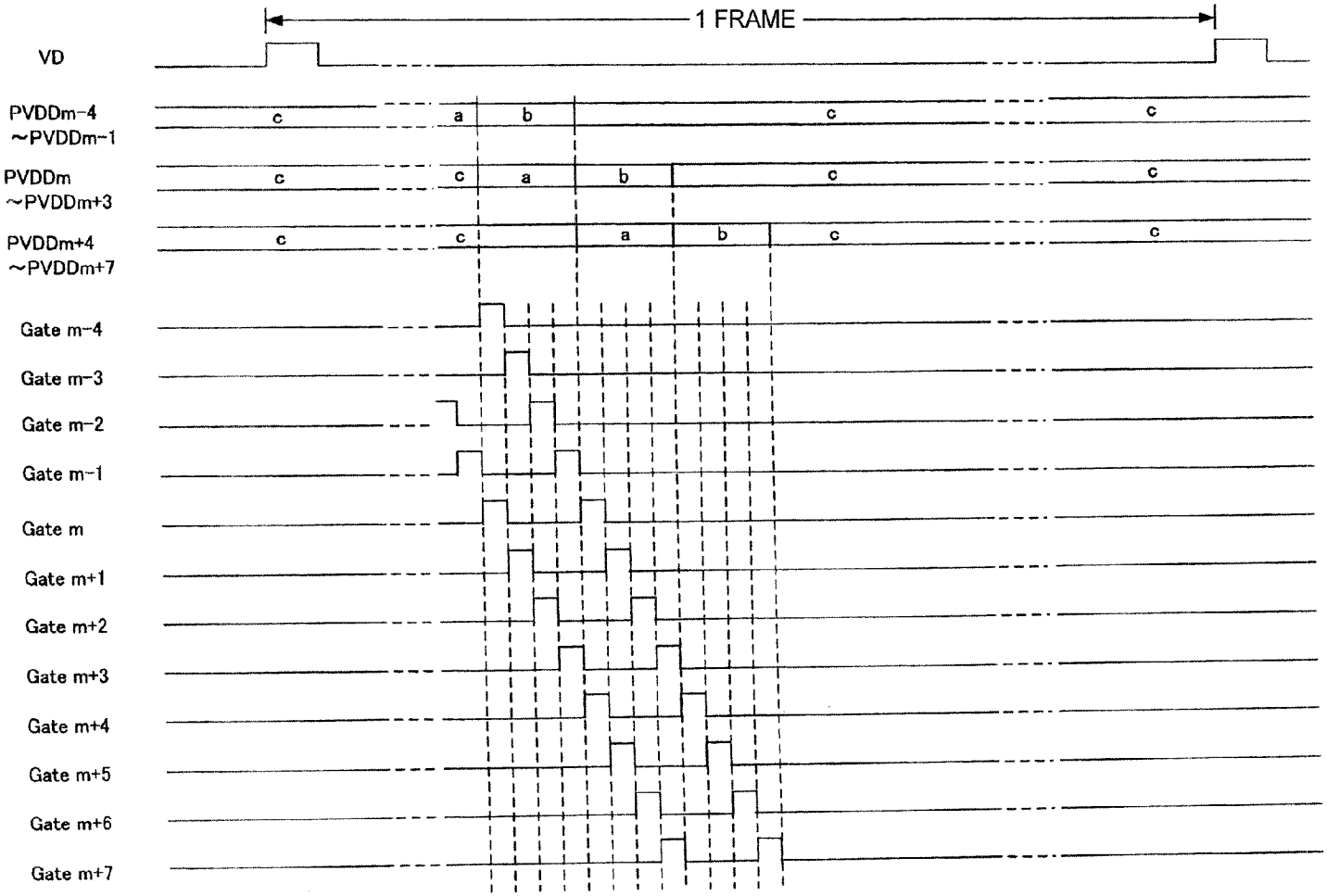
FIG. 14 is a diagram illustrating states of switches connecting the horizontal PVDD lines and timings of gate line signals.

In a similar manner, it is possible to reduce the noise from the drive circuits inside the panel. In particular, as illustrated in FIG. 13, intruding noise from the gate selection lines is noticeable. In this case, when a pixel current of the pixels in the line m is measured, a dummy gate selection signal is output to the line m+4 (Gatem+4). FIG. 14 illustrates a timing chart on this occasion.

In this way, not only the selection TFTs in the pixels in the line m but also the selection TFTs in the pixels in the line m+4 are turned ON. Because the horizontal PVDD line in the line m+4 is connected to the vertical PVDD line PVDDa, no pixel current flows in the pixels in the line m+4 even when the selection TFTs 2 thereof are turned ON. As a result, only intruding noise of a drive pulse, such as the gate selection signal, flows to the PVDDa terminal.

Figure 15:
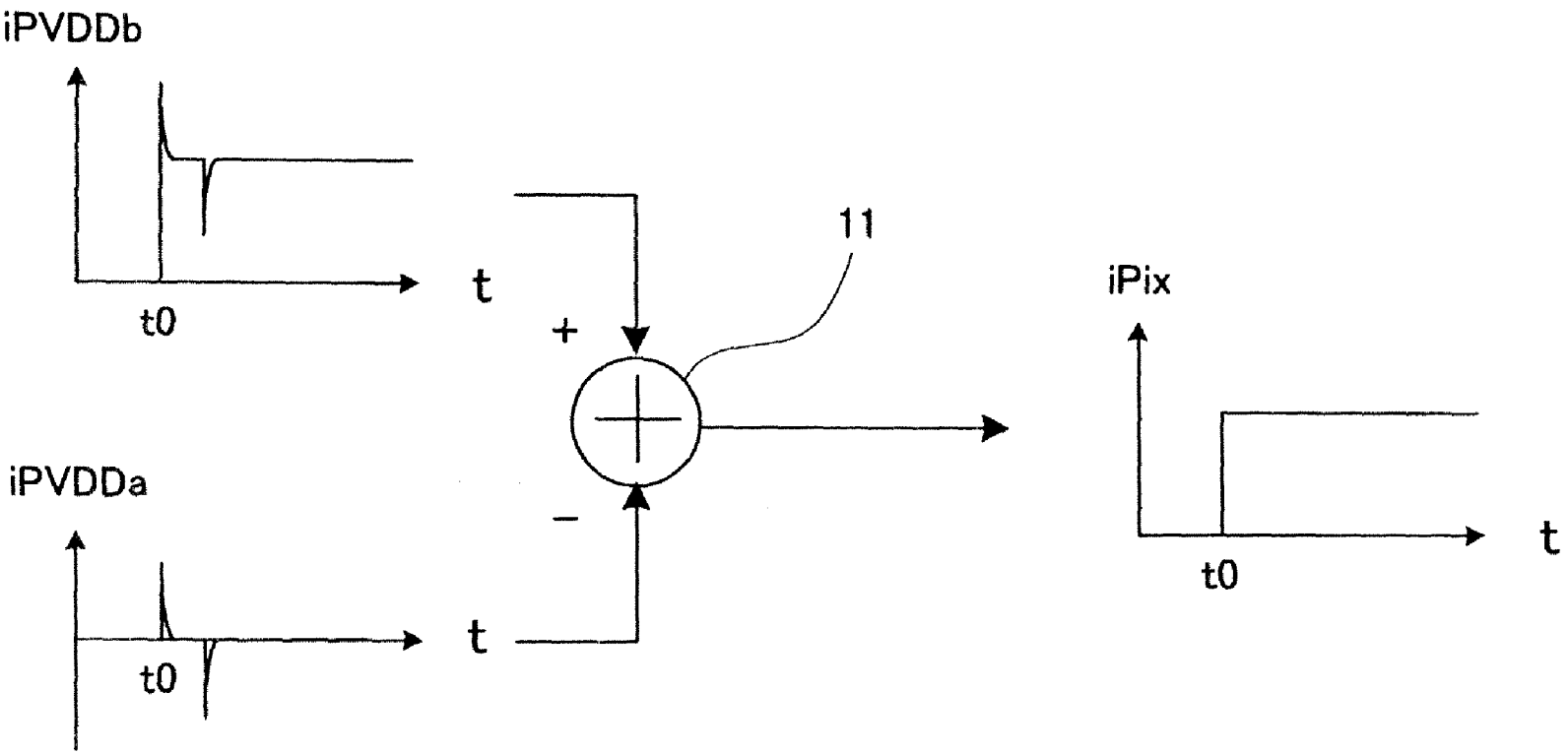
FIG. 15 is a diagram illustrating a configuration for removing noise.

Substantially equal noise (i3, i4) of the gate selection signals intrudes into the horizontal PVDD lines PVDDm and PVDDm+4. Therefore, as illustrated in FIG. 15, by subtracting a current value flowing to the PVDDa terminal from a current value flowing to the PVDDb terminal, it is also possible to reduce the intruding noise from the internal drive pulse.

Figure 16:
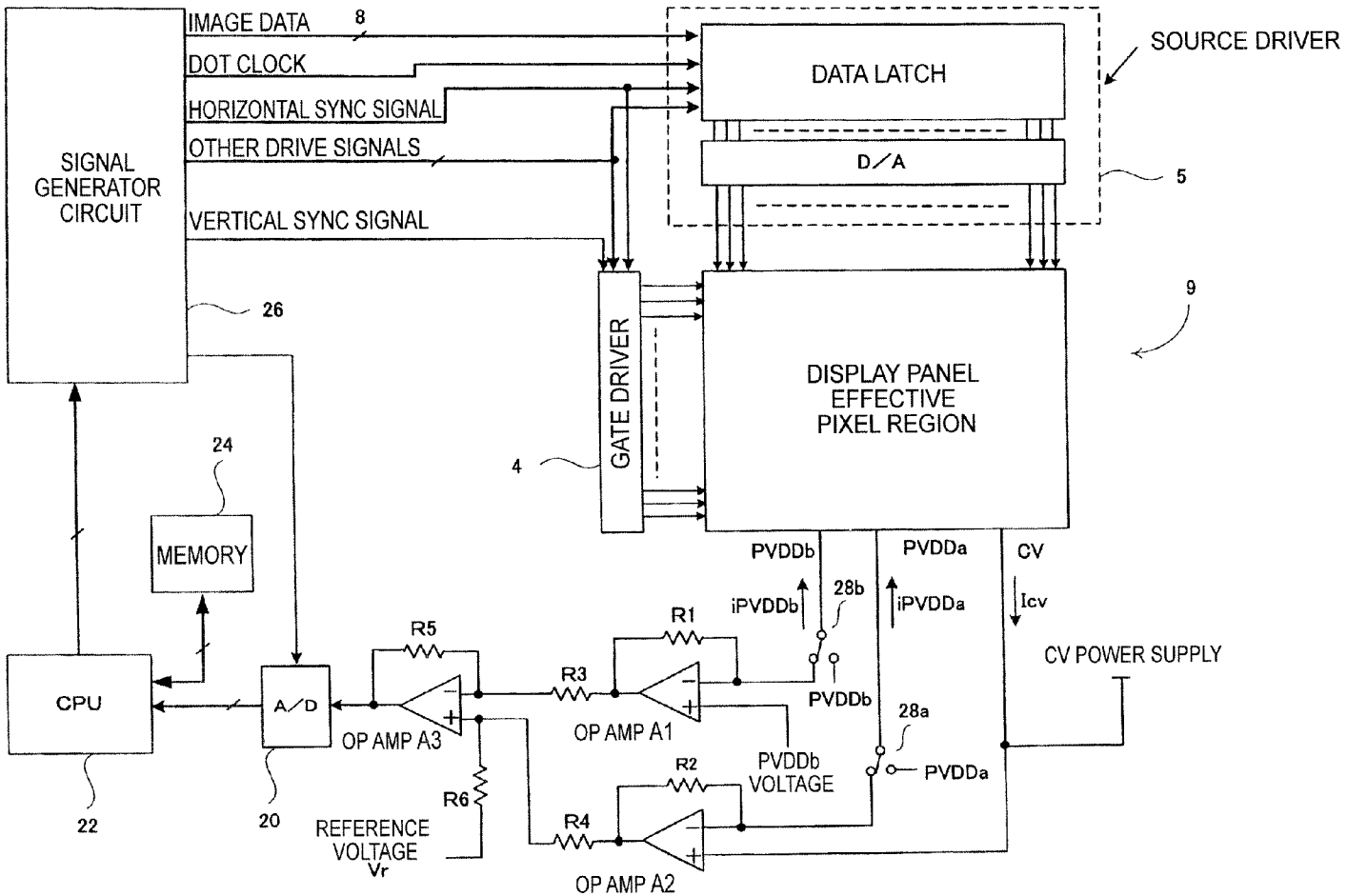
FIG. 16 is a diagram illustrating a specific exemplary configuration for removing noise.

FIG. 16 illustrates a configuration example of a pixel current measuring circuit. The PVDDb terminal is connected to a negative input terminal of an operational (OP) amplifier A1. A positive input terminal of the OP amplifier A1 is supplied with a PVDDb voltage. Accordingly, a voltage of the negative input terminal of the OP amplifier A1 is also the PVDDb voltage. The PVDDa terminal is connected to a negative input terminal of an OP amplifier A2. A CV terminal and the CV power source are connected to a positive input terminal of the OP amplifier A2. Accordingly, a voltage of the negative input terminal of the OP amplifier A2 is also the CV power supply voltage.

An output terminal and the negative input terminal of the OP amplifier A1 are connected via a resistor R1, and a voltage of $$V1=PVDDb+R1\cdot iPVDDb$$

is generated at the output of the OP amplifier A1. An output terminal and the negative input terminal of the OP amplifier A2 are connected via a resistor R2, and a voltage of $$V2=CV+R2\cdot iPVDDa$$

is generated at the output of the OP amplifier A2.

The output terminal of the OP amplifier A1 is connected to a negative input terminal of an OP amplifier A3 via a resistor R3. The output terminal of the OP amplifier A2 is connected to a positive input terminal of the OP amplifier A3 via a resistor R4. Further, the positive input terminal of the OP amplifier A3 is supplied with a reference voltage Vr via a resistor R6. The positive input terminal and the negative input terminal of the OP amplifier A3 are connected via a resistor R5. An output terminal of the OP amplifier A3 is input to an A/D converter 20. If R3=R4, R5=R6, and Vr=0 V, the output of the OP amplifier A3 takes a value of $$(V2-V1)R5/R3=(CV-PVDDb+R2\cdot iPVDDa-R1\cdot iPVDDb)R5/R3,$$

which is $R5/R3$ times the difference between the output V2 of the OP amplifier A2 and the output V1 of the OP amplifier A1.

"CV-PVDDb" is a known fixed voltage, and hence by appropriately setting the similar fixed voltage Vr, it is also possible to extract $$(R2\cdot iPVDDa-R1\cdot iPVDDb)R5/R3,$$

which is a value determined by multiplying iPVDDa and iPVDDb by the respective coefficients and obtaining the difference therebetween. The coefficients can be determined by selection of the respective resistances.

The output of the A/D converter 20 is supplied to a CPU 22. The CPU 22 is connected to a memory 24, which stores a characteristic value or a correction value of each pixel based on a measurement result of the pixel current.

The CPU 22 is further connected to a signal generator circuit 26, and controls image data to be supplied for measurement and other various signals.

In the circuits described above, a pixel in the display panel 9 is selected and a certain voltage is applied to the pixel to measure the iPVDDb current flowing at that time, in which a noise component is removed.

Further, a switch 28*a* and a switch 28*b* are provided in paths from the PVDDa terminal and the PVDDb terminal, respectively. Therefore, in a normal display operation, the PVDDa power source and the PVDDb power source can be directly connected to the PVDDa terminal and the PVDDb terminal, respectively.

As described above, according to this embodiment, the two kinds of vertical PVDD lines are provided, and when measuring the pixel current, one kind of power source is connected only to a group of lines to which the pixel to be measured belongs, and a power supply current at that time is measured. In this way, during the measurement, almost all of the other pixel circuits are not connected by the switches, and hence a line parasitic capacitance is small and the influence of noise due to leakage currents is negligible. The influence of intruding noise from outside the panel and noise from the drive circuits inside the panel can be detected by the other power supply lines connected to the other groups, and hence the noise can be removed by obtaining the difference.

What is claimed is:

1. An active matrix type display device, comprising:

pixels arranged in matrix, each including a current-driven type light emitting element and a transistor for controlling a current of the current-driven type light emitting element to perform display;

horizontal power supply lines arranged in a horizontal direction, for supplying a current to pixels in respective corresponding horizontal lines; and switches for connecting each group of the horizontal power supply lines, the each group including at least one horizontal power supply line, to one of a first power supply line and a second power supply line in a switchable manner, the first power supply line and the second power supply line being disposed outside a pixel region, wherein only the at least one horizontal power supply line in a group to which a pixel to be measured belongs is supplied with power from one of the first power supply line and the second power supply line so as to measure a current of each pixel in the group, and a current flowing into a power source connected to a group to which other pixels than the pixel to be measured belong is measured, to thereby calculate a pixel current based on a difference between the two measured currents.

2. A display device according to claim 1, wherein the pixel current is a value determined by subtracting, from a current flowing into another power source connected to the group to which the pixel to be measured belongs, a value determined by multiplying, by a coefficient, a current flowing into the power source connected to at least one group to which the pixels other than the pixel to be measured belong.

* * * * *